US008033222B1

(12) United States Patent
Sutula, Jr. et al.

(10) Patent No.: US 8,033,222 B1
(45) Date of Patent: Oct. 11, 2011

(54) LINE-LOCKING CONNECTOR CLIP

(75) Inventors: Daniel P. Sutula, Jr., Bristol, CT (US); Mark T. Andersen, Winsted, CT (US); Basilio J. Carneiro, West Hartford, CT (US); Lawrence J. Shank, III, East Hartland, CT (US); John Childs, Granby, CT (US)

(73) Assignee: Dyno Nobel Inc., Salt Lake City, UT (US)

( * ) Notice: Subject to any disclaimer, the term of this patent is extended or adjusted under 35 U.S.C. 154(b) by 414 days.

(21) Appl. No.: 11/861,751

(22) Filed: Sep. 26, 2007

Related U.S. Application Data

(60) Provisional application No. 60/847,769, filed on Sep. 27, 2006, provisional application No. 60/886,802, filed on Jan. 26, 2007.

(51) Int. Cl.
*C06C 5/06* (2006.01)

(52) U.S. Cl. ..... 102/275.7; 102/275.12

(58) Field of Classification Search ..... 102/275.2, 102/275.3, 275.7, 275.12
See application file for complete search history.

(56) References Cited

U.S. PATENT DOCUMENTS

| | | | | | |
|---|---|---|---|---|---|
| 3,205,818 | A | * | 9/1965 | Coulson | 102/275.4 |
| 3,349,706 | A | * | 10/1967 | Schaumann | 102/275.7 |
| 3,993,001 | A | * | 11/1976 | Hawes | 89/1.14 |
| 4,248,152 | A | * | 2/1981 | Yunan | 102/275.4 |
| 4,485,741 | A | * | 12/1984 | Moore et al. | 102/331 |
| 4,495,867 | A | * | 1/1985 | Mitchell et al. | 102/275.4 |
| 4,722,279 | A | * | 2/1988 | Yunan | 102/275.4 |
| 4,730,560 | A | * | 3/1988 | Bartholomew et al. | 102/275.3 |
| 4,771,694 | A | * | 9/1988 | Bartholomew et al. | 102/275.7 |
| 4,998,478 | A | * | 3/1991 | Beck | 102/275.7 |
| 5,012,741 | A | * | 5/1991 | Peebles et al. | 102/275.4 |
| 5,069,131 | A | * | 12/1991 | Kennedy et al. | 102/275.6 |
| 5,070,789 | A | * | 12/1991 | True et al. | 102/275.12 |

(Continued)

FOREIGN PATENT DOCUMENTS

ZA 2005/04429 4/2006

(Continued)

OTHER PUBLICATIONS

International Search Report and Written Opinion for PCT/US07/20759, mailed Feb. 27, 2008, 9 pages.

(Continued)

*Primary Examiner* — Bret Hayes
(74) *Attorney, Agent, or Firm* — Cantor Colburn LLP

(57) ABSTRACT

A connector clip (10, 10') defines a line-retaining slot (34) and is configured to receive a detonator (16) therein. The connector clip (10, 10') comprises a body member (12, 12') and a closure member (14, 14') which are mounted, one on the other, for movement relative to each other along a travel path between an open position in which the line-retaining slot (34) is accessible to lateral insertion therein of one or more signal transmission lines (68), and a closed position in which the line-retaining slot (34) is closed to secure such signal transmission lines (68) therein. One of the body member (12, 12') and the closure member (14, 14') defines a cavity within which at least part of the other of the body member (12, 12') and the closure member (14, 14') is encased during travel between the open position and the closed position. The travel path between the open position and the closed position may be as short as from the width of line-retaining slot (34) including its access opening (38), to about two times that width.

24 Claims, 15 Drawing Sheets

U.S. PATENT DOCUMENTS

| | | | | | |
|---|---|---|---|---|---|
| 5,171,935 | A | | 12/1992 | Michna et al. | |
| 5,204,492 | A | | 4/1993 | Jacob et al. | |
| 5,299,500 | A | * | 4/1994 | Lindquist et al. | 102/275.12 |
| 5,375,525 | A | | 12/1994 | Greenslade et al. | |
| 5,398,611 | A | | 3/1995 | Michna et al. | |
| 5,423,263 | A | * | 6/1995 | Rontey et al. | 102/275.12 |
| 5,499,581 | A | | 3/1996 | Sutula, Jr. | |
| 5,708,228 | A | * | 1/1998 | Sutula et al. | 102/275.7 |
| 5,792,975 | A | | 8/1998 | Tseka et al. | |
| 6,006,671 | A | * | 12/1999 | Yunan | 102/275.11 |
| 6,123,025 | A | * | 9/2000 | Jacob et al. | 102/275.12 |
| 6,425,332 | B1 | * | 7/2002 | Capers et al. | 102/318 |
| 6,880,465 | B2 | * | 4/2005 | Badger et al. | 102/275.7 |
| 6,966,260 | B1 | * | 11/2005 | Martinez | 102/202.11 |
| 2002/0100388 | A1 | * | 8/2002 | Perry | 102/275.7 |
| 2004/0055494 | A1 | * | 3/2004 | O'Brien | 102/275.12 |
| 2005/0034625 | A1 | * | 2/2005 | Chan et al. | 102/275.12 |
| 2008/0257191 | A1 | | 10/2008 | Ayensa Muro | |

FOREIGN PATENT DOCUMENTS

| | | |
|---|---|---|
| ZA | 2005/04430 | 4/2006 |

OTHER PUBLICATIONS

Patent Joernaal, Apr. 2006, p. 531, Publication of South African Patents 2005/04429 and 2005/04430.

* cited by examiner

LINE-LOCKING CONNECTOR CLIP

CROSS-REFERENCE TO RELATED APPLICATIONS

This application claims the benefit of priority of provisional patent application Ser. No. 60/847,769, entitled "FAST LOADING CONNECTOR CLIP", filed on Sep. 27, 2006, and provisional patent application Ser. No. 60/886,802, entitled "LINE-LOCKING CONNECTOR CLIP", filed on Jan. 26, 2007.

BACKGROUND OF THE INVENTION

1. Field of the Invention

The present invention relates to connector clips of the type used to connect a plurality of signal transmission lines, such as shock tube, in signal transfer proximity to the explosive end of a detonator. More particularly, the present invention concerns a connector clip which enables fast and easy loading of one or a plurality of signal transmission lines through an access opening into a slot, followed by closing the access opening by means of a closure member.

2. Related Art

Connector clips for connecting one or a plurality of outgoing signal transmission lines, such as shock tubes, in signal transfer communication with a detonator mounted in the clip are well-known in the art.

U.S. Pat. No. 5,171,935, issued Dec. 15, 1992 to Richard J. Michna et al. for "Low-Energy Blasting Initiation System Method and Surface Connection Thereof", and its grandchild continuation case, U.S. Pat. No. 5,398,611 of Richard J. Michna et al. entitled "Low-Energy Blasting Initiation System, Method and Surface Connection Therefor", each shows a connector clip in which up to four outgoing signal transmission lines, in this case, shock tubes, are disposed within a slot in the clip in signal transfer communication with a low-energy detonator disposed in the body of the clip. Such connector clips are conventionally employed on the surface of a shot field and low-energy detonators are usually employed in the clips in order to reduce noise and the throwing of shrapnel which might prematurely sever connecting lines.

A typical blasting arrangement using such connector clips is schematically illustrated in FIG. 5 of the above-mentioned Michna et al. patents. As shown therein, the connector clips are employed on the surface to transmit signals via connector lines to detonators in a series of boreholes containing explosive charges. Such connector lines are subject to significant tensile stresses during assembly of the shot, as lines are often dragged over rough terrain, played out from borehole to borehole and pulled on to reach connection points. There are two conflicting objectives involved in such assembly operations. It is desired to insert the lines, e.g., shock tubes (40) of the Michna et al. patents, into a line-retaining slot, e.g., slot (37) of FIG. 4 of the Michna et al. patents, as quickly and as easily as possible. On the other hand, once inserted, the shock tubes (40) must resist being pulled out of the slot (37) by tensile stresses imposed on the shock tubes during preparation of the shot. These conflicting objectives may be referred to as the (signal transmission) line insertion and retention problem.

The Michna et al. patents address the line insertion and retention problem by providing the structures (e.g., 42, 43 of FIG. 2) to render the access opening to the slot (37) somewhat smaller than the outside diameters of the tubes (40). See, for example, U.S. Pat. No. 5,171,935 at column 4, lines 56-66. While this expedient helps to retain the tubes (40) in place within slot (37), it creates difficulty in inserting plastic shock tubes or other signal transmission lines into the slot in the first place, especially in cold weather. Shock tubes become less malleable in cold weather, creating difficulty in compressing the tubes sufficiently to squeeze them through the small access opening. The problem is compounded by the fact that changes in temperature cause slight, but not insignificant, changes in the tube outside diameter and in the width of the opening itself. The Michna '935 Patent discloses at column 4, lines 36-38, that segment 36 is "a resiliently deformable segment" and at column 4, lines 48-50, it is stated that the segment 36 is of reduced thickness relative to the housing "thereby allowing it to flex or bend under force." It appears that this flexibility is designed to accommodate the fact that, as disclosed at column 4, lines 56-59, the width of the line-receiving slot 37 "is slightly smaller than the outside diameter of a transmission tube 40 to securely hold each tube . . . " It appears that the flexibility of neck 36 enables the retaining member 35 to flex somewhat to accommodate the oversized (relative to the width of the line-retaining slot) transmission tubes 40.

Generally, up to six or so shock tubes or other signal transmission lines may have to be inserted into the line-retaining slot. For example, U.S. Pat. No. 5,792,975 of Thomas C. Tseka et al. for "Connector Block Having Detonator-Positioning Locking Means", shows a generally C-shaped arcuate slot 15 (FIG. 2) within which six shock tubes (40) are retained. It will be noted from FIG. 2A of the Tseka et al. patent that the opening (38) through which the shock tubes are laterally inserted into the C-shaped slot is shown significantly smaller than the outside diameter of the shock tubes retained therein. Like the Michna et al. patents described above, this configuration suffers from the same difficulties in inserting the shock tubes (40) into the C-shaped slot.

U.S. Pat. No. 5,204,492, issued Apr. 20, 1993 to Merritt Jacob et al. for "Low Noise, Low Shrapnel Detonator Assembly For Initiating Signal Transmission Lines", addresses the tube insertion and retention problem by providing a closure means which is movable between an open and a closed position so that the shock tubes (14b in FIGS. 4-6 and 8) may be inserted adjacent the explosive end of a detonator retained in the connector clip (in this case, the tubes lie parallel to the longitudinal axis of the detonator to gain the purported advantages described in the Jacob et al. Patent). After the tubes are inserted while the closure means is in the open position (FIG. 10) the closure means are then closed to lock the tubes in place. See column 6, line 55 through column 7, line 44 of the Jacob et al. Patent.

Connector clips used in the field lie on the ground and are exposed to sand, dirt, small particles of rock and other solid foreign material. Entry of such solid foreign material to the travel path of the closure means (e.g., item (42) in FIG. 10 of the Jacob et al. Patent) will interfere with or even preclude secure locking of the closure means to retain the tubes (14b) in place. Obviously, if the locking is not secure, one or more of the tubes inserted into the line-retaining slot may be pulled free by tensile forces acting on the tubes during preparation of the shot, resulting in mis-fires. The Jacob et al. patent also provides for inserting the shock tubes (14b) transversely of the detonator, which is the common and usually preferred practice. However, in the illustration of this embodiment in FIG. 11, Jacob et al. does not provide closure means movable between an open and closed position. Instead there is a conventional entry slot (34 in FIG. 11 of the Jacob et al. patent) which has an entrance to the C-shaped slot which entrance, as illustrated in FIG. 11, appears to be smaller than the outside diameter of the shock tubes (14b). At column 7, lines 51-53, Jacob et al. does state with respect to FIG. 11 that a "closure can also be attached to the confining wall to close gap 34." The construction of such closure means is not described or illustrated.

SUMMARY OF THE INVENTION

The present invention provides improvements in a connector clip for retaining one or more signal transmission lines in proximity to a detonator having an explosive end. Such connector clips provide a body member configured to receive and retain such detonator therein, a closure member and a line retainer, the line retainer and the body member cooperating to define a line-retaining slot having an access opening configured to laterally receive therein one or more signal transmission lines in signal-transfer proximity to the explosive end of such detonator. The improvement provided by the present invention comprises that the closure member and the body member are mounted one on the other for movement relative to each other along a travel path between (1) an open position in which the line-retaining slot is accessible to lateral insertion therein of one or more signal transmission lines, and (2) a closed position in which the line-retaining slot is closed to secure such signal transmission lines therein.

Another aspect of the present invention provides that one of the closure member and the body member defines a cavity within which at least part of the other of the closure member and the body member is encased during travel from the open position to the closed position. For example, the closure member may define a cavity within which at least part of the body member is encased.

In one aspect of the present invention, the closure member and the body member are slidable relative to each other for movement along the travel path between the open position and the closed position; in another aspect of the present invention the closure member and the body member are pivotable relative to each other for movement along the travel path between the open position and the closed position.

The present invention also provides for the access opening to have a width A and for relative movement between the closure member and the body member in moving between the open position and the closed position to be about between A and 2A, e.g., about equal to A.

One aspect of the present invention provides that such signal transmission lines have outside diameters and the line-retaining slot, including its access opening, has a width which is not less than that of the outside diameters of such signal transmission lines, thereby enabling lateral insertion of such lines through the access opening into the slot without compression of the lines. The width of the line-retaining slot, as the term "width" is used herein, is the dimension "W" shown in FIG. 6C, which is the shortest straight line extending from the floor to the roof of the retaining slot 34; the width is not the side-to-side dimension of the slot, which is illustrated by dimension L in FIG. 2. The width A of the access opening 38 is also shown in FIG. 6C. The width A may be slightly larger than or equal to the width W. That is, in some embodiments, the access opening a may be enlarged somewhat as compared to the width W in order to facilitate lateral insertion of the signal transmission lines, e.g., shock tubes, into line-retaining slot 34.

The width of at least an entry segment (the access opening) of the line-retaining slot, and preferably the entire length of the line-retaining slot, when the connector clip is in its open position is preferably equal to or greater than the outside diameters of such signal transmission lines to be laterally inserted into the line-retaining slot. The width of the line-retaining slot need not necessarily be uniform along its entire length although that is preferable, at least in the portion of the slot after the access opening.

Yet another aspect of the present invention provides that the body member has thereon a visible indicator which is at least partly obscured by the closure member when the members are in the open position and which is revealed or more fully revealed when the members are in the closed position.

The present invention also provides for the body member and the closure member to have thereon, respectively, a body member engagement formation and a closure member engagement formation, the formations cooperating with each other to comprise a locking member and being configured to engage each other when the members are in the closed position. In a related aspect of the present invention, the engagement formations are configured to create resistance to movement of the members from the closed position towards the open position, which resistance is strong enough to retain the members in the closed position, but is slight enough to be manually overcome by a user of the connector clip. The resistance is strong enough so that once overcome by the user to move the members out of the closed position to the open position, the user is signaled tactilely that the members have been released from the closed position.

Still another aspect of the present invention provides a sound-generating structure on one or both of the closure member and body member which emits an audible signal, such as a click, when the closure member and body member move into or out of the closed position. A related aspect of the present invention provides that the sound-generating member is part of the locking member.

One aspect of the present invention provides a connector clip configured to retain therein a detonator and to receive and retain therein one or more signal transmission lines having outside diameters in proximity to such detonator, such detonator having a longitudinal axis and an explosive end, the clip comprising the following components. A body member is configured to receive therein at least the explosive end of such detonator and a line retainer carried on the body member and defines a signal transmission line-retaining slot having an access opening, the slot and its access opening being configured to laterally receive therein one or more of such signal transmission lines disposed in signal-transfer proximity to the explosive end of such detonator, and with at least those portions of the lines which are confined within the slot disposed transversely, e.g., perpendicular, of the longitudinal axis. The present invention provides an improvement comprising that a closure member is connected to the body member, the closure member being movable along a travel path relative to the body member between (1) an open position in which the line-retaining slot is accessible via the access opening to lateral insertion therein of one or more of such signal transmission lines, and (2) a closed position in which the access opening of the line-retaining slot is closed by the closure member to secure such signal transmission lines within the slot. The improvement further comprises that the slot, including its access opening, has a width which is not less than that of the outside diameters of such signal transmission lines, thereby enabling lateral insertion of such lines through the access opening into the slot without compression of the lines.

Still another aspect of the present invention provides for the body member to comprise a longitudinally-extending first bore and the closure member to comprise a longitudinally-extending second bore. The first and second bores are aligned with each other and are configured to each receive a longitudinal portion of such detonator, at least when the closure member is in its closed position.

A related aspect of the present invention provides that the body member comprises a longitudinally-extending bore configured to receive at least a longitudinal portion of such detonator.

BRIEF DESCRIPTION OF THE DRAWINGS

FIGS. 6A-1 is a partial view, enlarged relative to FIG. 6A, of the body member engagement formation 40 of FIG. 6A;

DETAILED DESCRIPTION OF SPECIFIC EMBODIMENTS OF THE INVENTION

Figure 1:
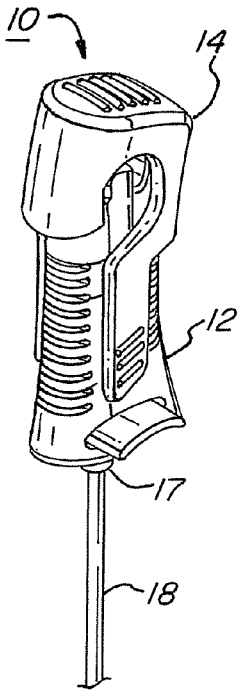
FIG. 1 is a perspective view of a connector clip according to one embodiment of the present invention and comprising a closure member and a body member.
Figure 2:
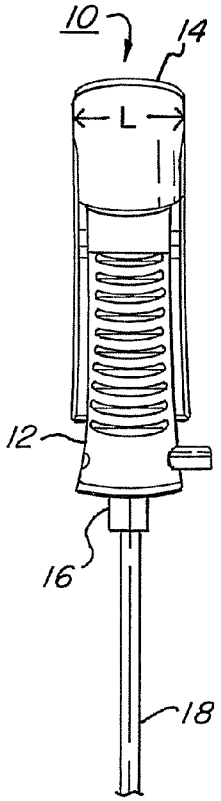
FIGS. 2-4 are, respectively, front, side and rear elevation views of the connector clip of FIG. 1.

Generally, the connector clips of the present invention comprise a body member and a closure member which are movable relative to each other between an open position in which a line-retaining slot is accessible for lateral insertion of signal transmission lines therein, and a closed position in which the signal transmission lines are securely locked within the line-retaining slot. (The term "lateral" insertion of the lines means sideways insertion of the lines as described more fully below.) Relative movement between the body member and the closure member may be attained by sliding one member relative to the other or pivoting one member relative to the other. In either case, the body and closure members preferably are so configured as to move at least partially one within the other to thereby block or at least greatly inhibit the entry of foreign material (sand, dirt, pebbles, etc.) between the two members.

In different embodiments of the invention, the closure member may be at least partly enclosed within the body member, or the body member may be at least partly enclosed within the closure member. Further, in some embodiments, the standard detonator received within the connector clip may be contained substantially entirely within the body member, or substantially entirely within the closure member, or it may extend through at least parts of both the body member and the closure member.

The body member and closure member are mounted on one another for sliding or pivoting movement relative to each other between the open and closed positions. For example, the body member may be at least partly fitted within the closure member in both the open and closed positions. In this way, a compact structure is attained and the body and closure members may be moved between the closed and open positions with only a small amount of relative movement. For example, the relative movement need not necessarily be greater than the width of the access opening of the line-retaining slot or slightly greater to provide secure closing of the line-retaining slot. The connector clip of the present invention may be readily moved between the open and closed position to insert transmission tubes and lock them in place by a simple clicking action with the thumb or a slight pulling apart of the closure and body members. This permits rapid insertion and locking into place of the signal transmission tubes. The resultant economy of motion and time saved for each installation of signal transmission tubes will accumulate to a considerable increase in efficiency and reduced time of assembly in a typical blasting shot which may contain many hundreds of such connector clips and many more hundreds of signal transmission lines to be connected therein. An added advantage of the short travel distance between the open and closed positions which results from the body and closure members being mounted to each other, e.g., with at least a part of one of the body and closure members being disposed within a cavity in the other member, is that this construction tends to inhibit the intrusion of solid foreign matter such as dirt, gravel, sand and the like into the connector clip, thereby facilitating opening and closing of the connector clip.

This short movement, click or push-pull operation stands in sharp contrast to, for example, to structures such as disclosed in Jacob et al. U.S. Pat. No. 5,204,492 and illustrated, for example, in FIGS. 4-10 thereof. Manipulation of the locking devices illustrated in those figures is awkward and may be difficult, for example, especially in cold weather when the user may be wearing gloves. Once the signal transmission tubes 14b of Jacob et al. are in place, the closure 42 must be pivoted together and latched in order to close it. If, as frequently happens, it is desired to re-open the locking member in order to adjust the signal transmission tubes or add an additional tube or tubes or remove a tube or tubes, the interlocking elements of closure 42 (see especially FIGS. 5, 6, 7 and 8) must be prised apart to be disengaged from each other in order to move the device to its open position. Under field conditions and especially in inclement or cold weather, this could be time-consuming and inefficient operation as compared to the thumb click or push-pull operation of the connector clip of the present invention. Further, as may best be appreciated from FIG. 10 of Jacob et al., opening the closure 42 in the field invites entry into the tube-retaining portion of solid foreign matter such as sand, dirt, etc.

FIGS. 1 and 2-6C show various views of a connector clip 10 and its component members comprising a body member 12 and a closure member 14 fitted onto the exterior of body member 12. The connector clip 10 is generally configured to retain one or more signal transmission lines (not shown in FIGS. 1 and 2-6C) in signal-transfer proximity to the explosive output end of a standard detonator, such as detonator 16 illustrated in FIG. 1A. Detonator 16 is of known, standard construction and comprises a cylindrical shell 16*a* having a closed end 16*b* and an open end 16*c*. An input fuse 18, e.g., shock tube, protrudes from closed end 16*c*. Fuse 18 is retained within shell 16*a* by a crimp 16*d* formed around a bushing 17. As is well known, an output explosive charge (not shown) is contained within shell 16*a* of detonator 16 at the closed end 16*b* thereof. A time delay train (not shown) may be contained within detonator 16 as is well known to those skilled in the art. In the perspective view of FIG. 1, detonator 16 is mounted within body member 12 so that only the detonator input fuse 18 and a portion of the bushing 17 of detonator 16 are visible. Body member 12 is configured to receive and retain the detonator 16 within a central bore 20 (FIG. 6C) which extends along a longitudinal axis of the body member 12.

The connector clip 10, like connector clips generally, is designed to retain one or more signal transmission lines, e.g., shock tubes, close enough to the closed (explosive) end 16*b* of detonator 16 so that functioning of the detonator 16 initiates a signal in each of the signal transmission lines retained in the line-retaining slot of the connector clip. Such signal-initiating proximity of the retained signal transmission lines to the explosive end of the detonator is sometimes herein referred to as "signal-transfer proximity".

Figure 6A:
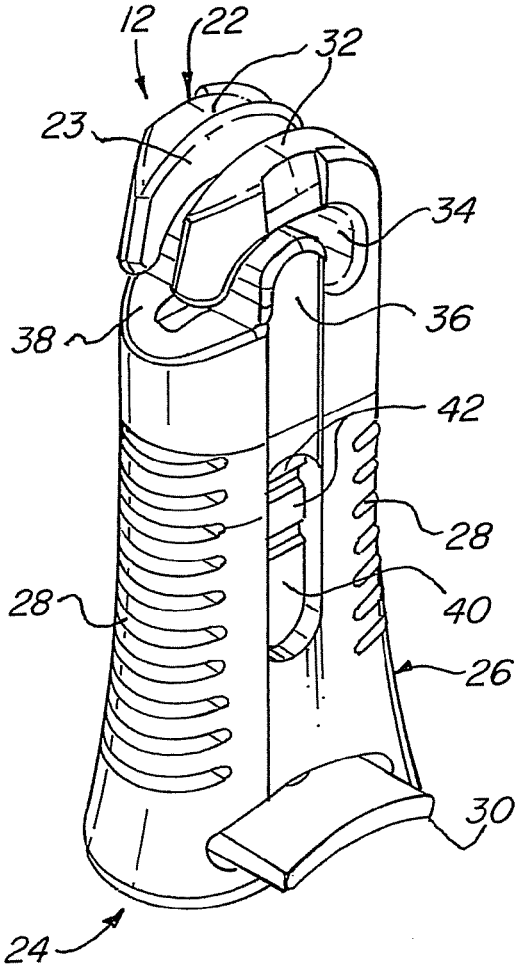
FIGS. 6A, 6B and 6C are, respectively, perspective, front and side views of the body member of the connector clip of FIGS. 1 and 2-4.
Figures 1, 6A:
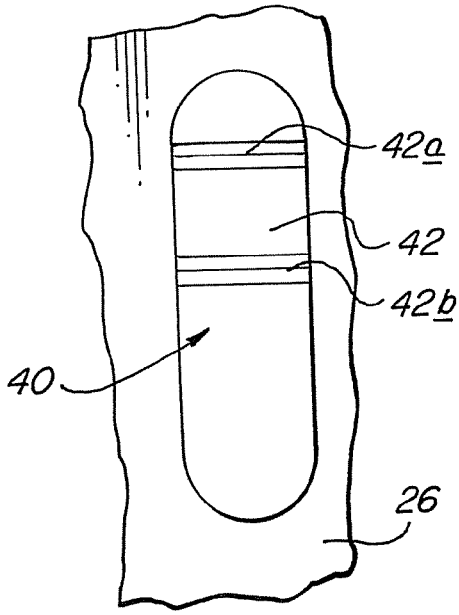
Figure 6B:
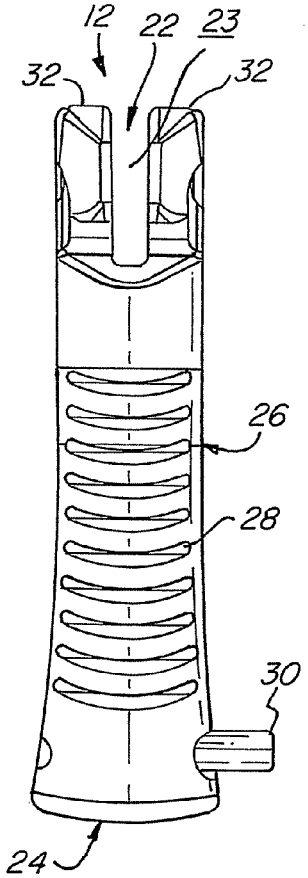

As shown in FIG. 6B, the body member 12 includes a line retention end 22 and an oppositely disposed locking end 24. A handle portion 26 extends between the line retention and locking ends 22 and 24, respectively, and includes grip elements 28 for facilitating gripping and handling of the connector clip 10. The grip elements 28 comprise recessed features such as slots farmed into a surface of the body member 12 and/or comprise raised protuberances formed or disposed on the surface of the body member 12. The grip elements increase the frictional resistance when a user grips body member 12 to manipulate connector clip 10 between the open and closed positions and to insert signal transmission lines therein. The slits also reduce somewhat the amount of material required to manufacture body member 12.

The locking end 24 of the body member 12 includes a locking element 30 disposed to slidingly engage the detonator 16 to fixedly retain such within the central bore 20. Locking element 30 may be connected to body member 12 by frangible webs which retain locking element 30 in a first position in which it does not block central bore 20 in order to permit insertion of detonator 16 into central bore 20. Once the detonator 16 has been inserted into bore 20, as part of the manufacturing process, force is applied to locking member 30 transversely of the longitudinal axis of bore 20 to rupture the frangible webs and move locking member 30 into a locking position in which it securely engages the crimp 16*d* of detonator 16 to retain detonator 16 in place with explosive end 16*b* thereof positioned within the bulb-shaped nose 36 (FIGS. 3 and 6A) which extends within and helps to define line-retaining slot 34, as described below with reference to FIG. 6C. Such locking members are known in the art; see U.S. Pat. No. 5,792,975 of Thomas C. Tseka et al., issued Aug. 11, 1998, and U.S. Pat. No. 5,499,581 of Daniel P. Sutula, Jr., issued Mar. 19, 1996.

Figure 6C:
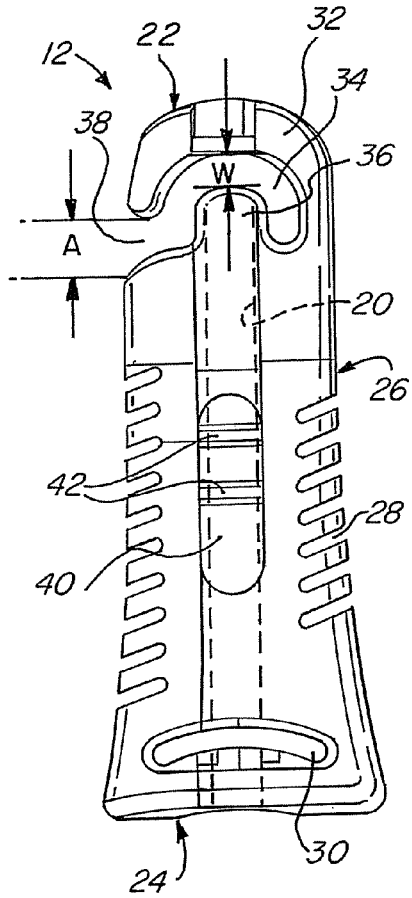

As shown in FIGS. 6A and 6C, the line retention end 22 of the body member 12 includes a line retainer 32 which, along with the handle portion 26, defines an arcuate line-retaining slot 34. That is, the handle portion 26 includes a bulb-shaped nose 36 which extends toward the line-retaining end 22. The combination of this bulb-shaped nose 36 and the line retainer 32 delimits the line-retaining slot 34. Line-retaining slot 34 extends transversely to the longitudinal axis of the body member 12 and terminates in an access opening 38 which is configured to laterally receive therein one or more signal transmission lines. Reference herein and in the claims to "lateral" insertion of the signal transmission lines into the line-retaining slot, or to the signal transmission lines being "laterally" received within the line-retaining slot, or words of like import, means that intermediate sections of the signal transmission lines are inserted sideways into the line-retaining slot. This is intended to distinguish from inserting a terminal end of the signal transmission line into the line-retaining slot in the manner of inserting thread into the eye of a needle. Such threading end-insertion is normally not an option with signal transmission lines because the lines will normally have one of a detonator, a connector clip, or a flattened seal portion at each of its ends, making such end-insertion impossible. Further, even if a terminal end of the signal transmission line were unencumbered, the signal transmission lines may be dozens or even hundreds of feet in length and the segment of a given signal transmission line which is to be inserted into the line-retaining slot is often far removed from either terminal end of the line.

The line-retaining slot 34 is shaped so as to position the signal transmission lines in signal-transfer proximity to an explosive end of the detonator 16. For this reason, an arcuate shape (as seen in side view) is usually preferred for the line-retaining slot. In this regard, see U.S. Pat. No. 5,171,935 of Richard J. Michna et al., issued Dec. 15, 1992, and its continuation case U.S. Pat. No. 5,398,611 of Richard J. Michna et al., issued Mar. 21, 1995. The line retainer 32 serves to contain the signal transmission lines within the line-retaining slot 34. The access opening 38, in this embodiment, has a width W greater than or equal to a diameter of the signal transmission lines. In another embodiment, the width W is less than the diameter of the signal transmission lines.

As shown in FIGS. 6A and 6C, the body member 12 further includes body member engagement formations 40 disposed on opposite sides of the body member 12 at the handle portion 26 thereof. Body member engagement formations 40 each comprises a recessed area of the body member 12 which extends along a longitudinal axis of the body member 12. The engagement formations 40 include body member engagement contourings 42 disposed therein. As discussed in detail herein, the body member engagement formations 40 facilitate actuation of the closure member 14 upon the body member 12, and further facilitate securement of the closure member 14 to the body member 12.

The closure member 14, best seen in FIGS. 1, 3 and 5A-5C, is disposed in movable engagement on the body member 12. In this particular embodiment, closure member 14 is slidable relative to body member 12 between open and closed positions of the connector clip 10. In this manner, the closure member 14 is capable of an open position in which the line-retaining slot 34 of the body member 12 is accessible to lateral insertion therein of one or more signal transmission lines and a closed position (shown in FIGS. 1, 2 and 3) in which the line-retaining slot 34 is closed to secure such signal transmission lines therein. In the open position, closure member 14 would be displaced upwardly as viewed in FIG. 3, in a manner analogous to that shown, for example, in FIG. 9A. The closure member 14 is further configured so as to inhibit entry of foreign solid particles into a travel path of the closure member 14 extending between the open position and the closed position. This is attained by having the contours of the interior of closure member 14 conform closely to the contours of the exterior of body member 12. This would include the interior of first flange element 48 (FIG. 5A) conforming closely to the contours of the bifurcated line retainer 32 (FIG. 6A) or to the unbifurcated line retainer 3T of FIG. 7.

Figure 5A:
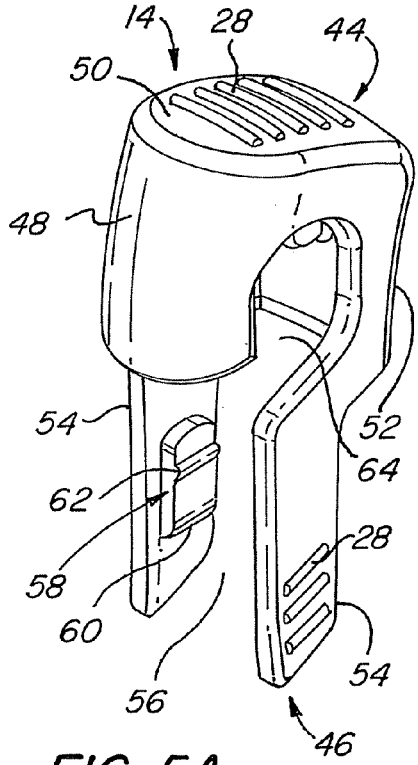
FIGS. 5A, 5B and 5C are, respectively, perspective, front and side views of the closure member of the connector clip of FIGS. 1 and 2-4, with a portion of the closure member broken away in FIG. 5C.
Figure 5B:
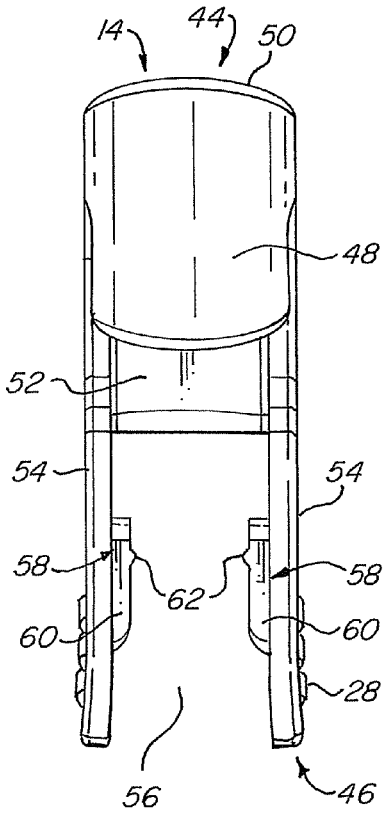
Figure 5C:
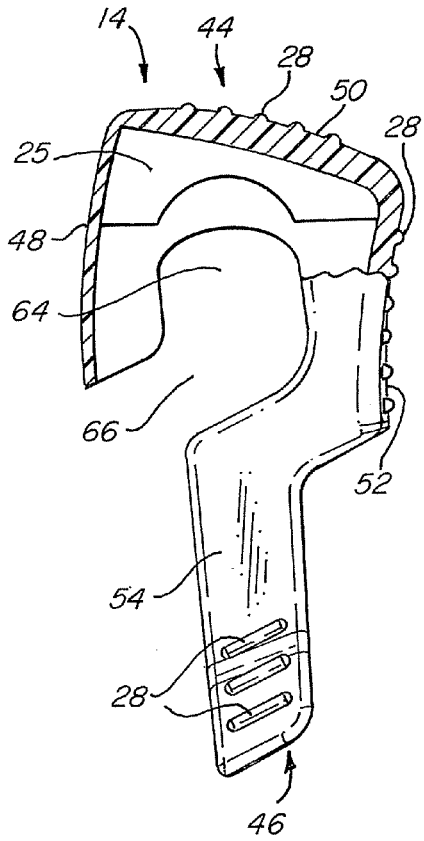

As shown in FIG. 5C, the closure member 14 includes a closure end 44 and an opposite engagement end 46. The closure end 44 is configured such that when the closure member 14 is on body member 12 in the closed position, shown in FIG. 3, the signal transmission lines are prevented from being withdrawn from the line-retaining slot 34. As seen in FIG. 5A, the closure end 44 includes a first flange element 48 disposed so as to extend across the access opening 38 (FIG. 6A) of the body member 12 when the closure member 14 is in the closed position. The first flange element 48 as shown in the drawings (best seen in FIG. 5A) extends from a top piece 50 of the closure member 14 in a generally longitudinal direction toward the engagement end 46. The closure member 14 further includes a second flange element 52 (FIG. 5A) which extends from the top piece 50 opposite from the first flange element 48. The second flange element 52 extends in a direction similar to the first flange element 48, i.e., toward the engagement end 46 of the closure member 14.

As seen in FIG. 5A, the engagement end 46 of the closure member 14 includes a pair of spaced-apart legs 54 extending generally longitudinally from the closure end 44. The legs 54 define a cavity 56 which receives the body member 12 as discussed below. Each of the legs 54 includes a closure member engagement formation 58 (FIG. 8E) configured to engage with the body member engagement formations 40 (FIG. 9A). The engagement of the formations 40 and 58 allows relative travel of the closure member 14 and the body member 12 between the open and closed positions. This engagement further allows a locking securement between the closure member 14 and the body member 12 in the closed position. Additionally, the formations 40 and 58 may be further configured to retain the body member 12 and the closure member 14 in the open position where said retention may be overcome by a suitable force (e.g., a longitudinal force) applied to either or both members 12 and 14. The application of the force needed to set or to overcome the retention provides the user with a tactile indication that the closure member 14 is either placed into the open position or is moved toward the closed position, respectively. Formations 40 and 58 may be so constructed that an audible click is heard when the members 12 and 14 are disengaged from the open position and when they engage in the closed position.

In this exemplary embodiment, the closure member engagement formations 58 (FIG. 5A) are raised protuberances 60 disposed on the interior of the legs 54. Each protuberance 60 includes closure member engagement contouring 62.

The protuberances 60 are particularly configured to be received and retained within the respective recesses 40 of the body member 12. The cavity 56 formed by the legs 54 is dimensioned approximately equal to a cross-sectional area of the body member 12 at the handle portion 26. In this way, legs 54 fit snugly upon the handle portion 26 of body member 12 when the body member 12 is received within the cavity 56. Thus, the protuberances essentially snap-fit into the recesses 40 and are held therein due to the rigidity of the legs 54 which resists an outward, disengaging movement thereof. The protuberances 60 are further configured to travel within the recesses 40 to move the body and closure members 12 and 14, i.e., connector clip, i.e., between the open and closed positions. As mentioned above, the recesses 40 extend along the longitudinal axis of the body member 12. Thus, the engagement of protuberances 60 within the recesses 40 allow movement between the body member 12 and the closure member 14 along the longitudinal axis.

Figure 1A:
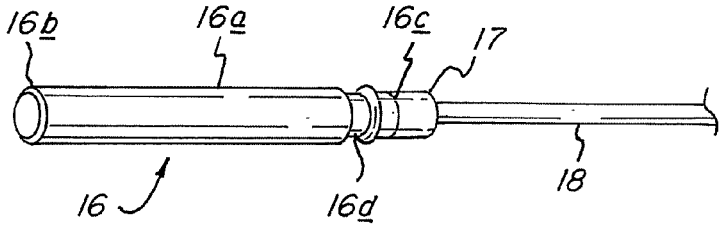
FIG. 1A (PRIOR ART)
FIG. 1A shows a known standard type of detonator usable both with prior art connector clips and with the connector clips of the present invention.

The body member engagement contouring 42 of the recesses 40 (FIG. 6A) includes a first and a second inset portions 42*a*, 42*b* (FIGS. 6A-1). The first inset portion 42*a* receives and retains the closure member engagement contouring 62 (FIG. 5A) when the connector clip 10 is in the open position. The second inset portion 42*b* receives and retains the closure member engagement contouring 62 when the connector clip 10 is in the closed position. The first and second inset portions 42*a*, 42*b* and/or the closure member engagement contouring 62 are configured to provide the desired tactile and, optionally, audible response to a user when manipulating the body and closure members between the open and closed positions of connector clip 10. The first and second inset portions and/or the closure member engagement contouring 62 are further configured to provide the desired locking securement when the closure member 58 is placed in the open position and, particularly, when placed in the closed position. That is, the size, shape and disposition of the first and second inset portions and/or the closure member engagement contouring 62 are chosen to establish the strength of the engagement of the respective formations 40 and 58, and the clicking or other sound they make when moving into and out of both the closed and open positions of connector clip 10.

Figure 3:
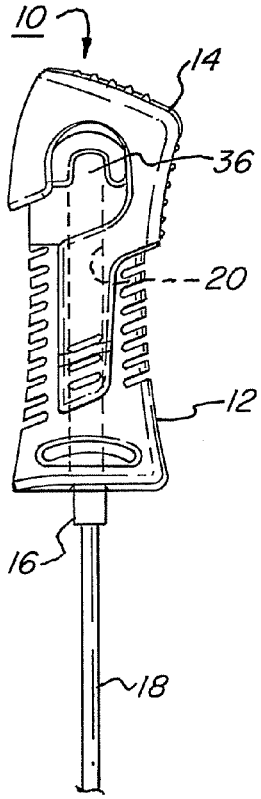
Figure 4:
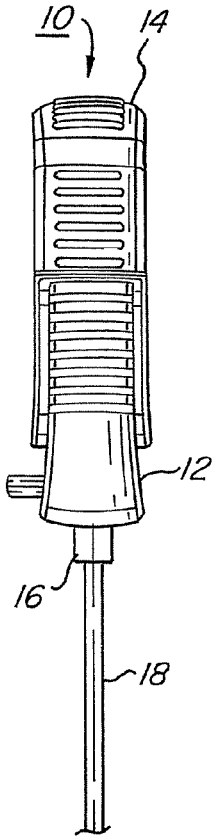

As may best be appreciated by considering FIGS. 3 and 4 in conjunction with FIG. 5A, the closure member 14 has formed therein a tube opening 64 which is configured to cooperate with bulb-shaped nose 36 of body member 12 (FIG. 6A) to allow passage of the signal transmission lines transversely through the connector clip 10 when the latter is either in the open or the closed positions or moving between these positions. The closure member 14 further includes an access opening 66 (FIG. 5C) delimited adjacent to the tube opening 64 which allows lateral entry of the signal transmission lines into the tube opening 64 when the connector clip 10 is in the open position.

Referring again to FIGS. 6A and 6B, it is seen that line retainer 32 is bifurcated to provide a slot 23 between the bifurcate halves of line retainer 32. Slot 23 is configured to receive a projecting flange 25 (FIG. 5C) which, when closure member 14 is moved relative to body member 12 to place connector clip 10 in its closed position, will bear upon the signal transmission lines contained within the line-retaining slot 5 (FIGS. 3 and 4) to securely press such signal transmission lines against bulb-shaped nose 36 to help secure the signal transmission lines in signal transfer proximity to the explosive end 16*b* of detonator 16.

Figure 7:
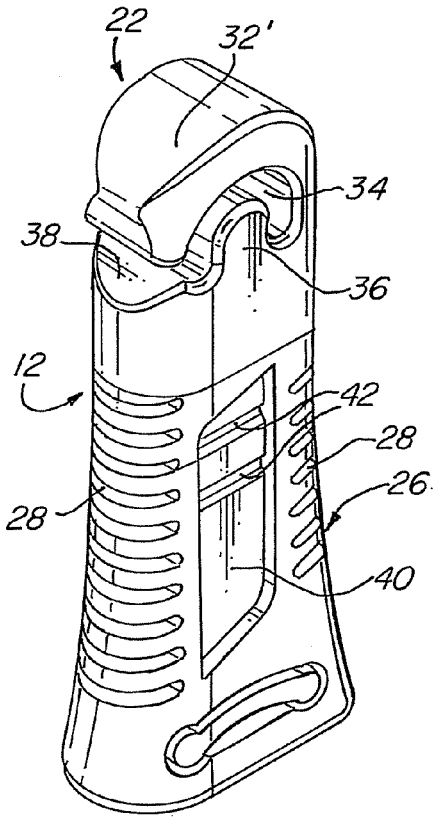
FIG. 7 is a view corresponding to that of FIG. 6A but showing a body member comprising a different embodiment of the invention.
Figure 8:
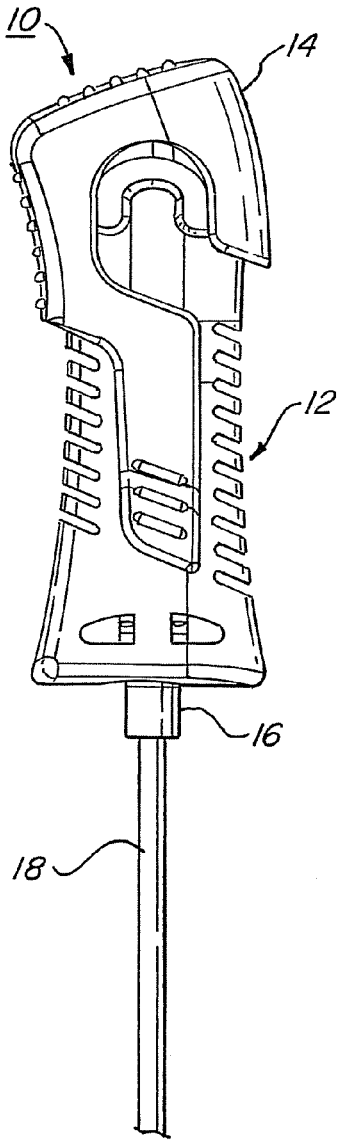
FIG. 8 is a side view of a connector clip according to a second embodiment of the present invention and showing a closure member assembled over the body member of FIG. 7.

FIG. 7 shows an alternate embodiment of body member 12 which is substantially identical in all respects to the embodiment of FIGS. 6A, 6B and 6C, except that the bifurcated line retainer 32 is replaced by a non-bifurcated line retainer 32'. Inasmuch as the other elements of the embodiment of FIG. 7 are identical to the embodiment previously described, the correspondingly parts are identically numbered to those of FIGS. 6A, 6B and 6C and are not further described herein. In the illustration of FIG. 7, the locking element 30 has been omitted.

The connector clip 10 may further include a visual feature (an embodiment of such is described below) disposed on the body member 12 and/or on the closure member 14 which is configured to visually indicate to a user when the closure member is secured in the open position and/or the closed position. Connector clip 10 may additionally to or alternatively to the visual feature include a structure which produces an audible sound, such as a click, etc., when the open and/or closed position is achieved.

As mentioned above, the closure member 14 may be configured so as to inhibit entry of foreign solid particles into a travel path of the closure member 14 extending between the open position and the closed position. This is accomplished in this exemplary embodiment by the legs 54 being shaped and sized to protectively cover the recesses of the body member engagement contouring 40 when the closure member 14 is in the closed position and in the opening position and when traveling therebetween.

Figure 9:
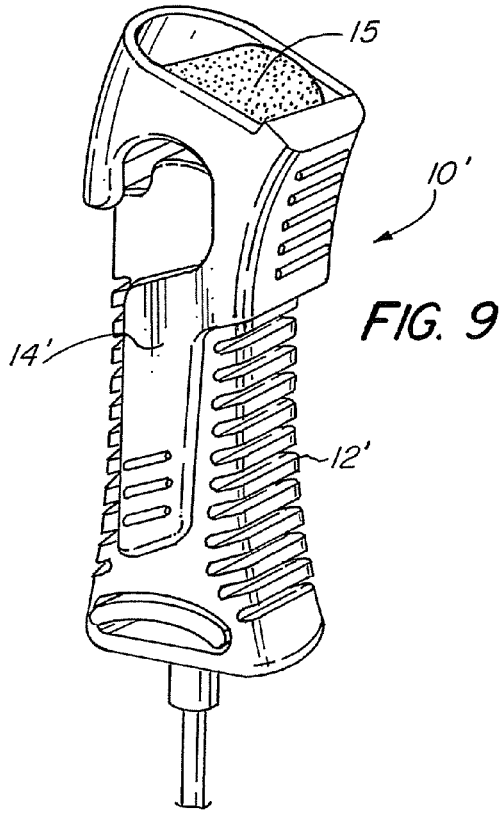
FIG. 9 is a side perspective view of a connector clip in accordance with a third embodiment of the present invention in its closed position.
Figure 9A:
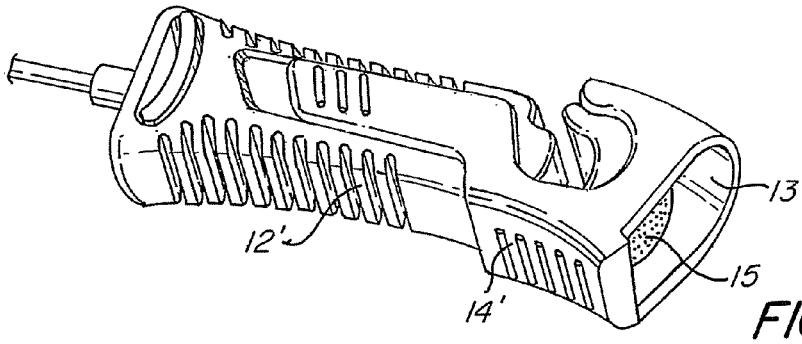
FIGS. 9A and 9B are top end views of the connector clip of FIG. 9 shown in its open position in FIG. 9A and in its closed position in FIG. 9B.
Figure 9B:
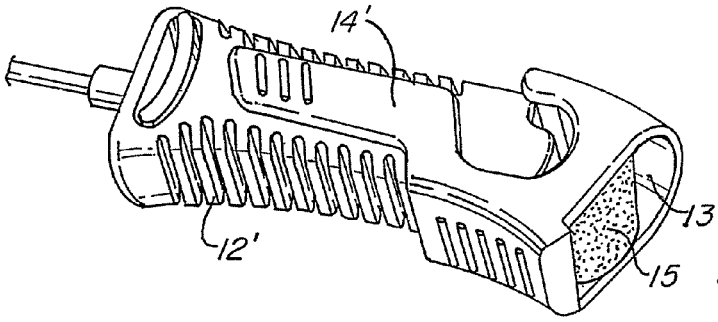
Figure 10C:
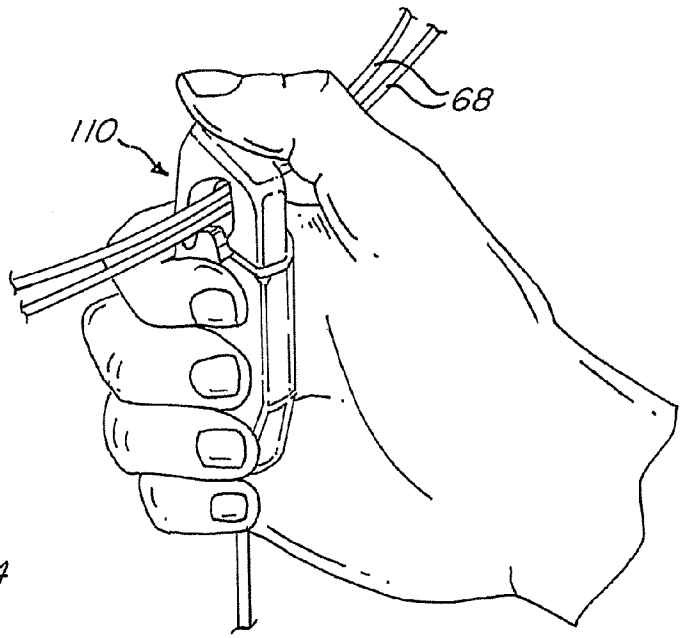
FIG. 10C shows the connector clip of FIGS. 10A and 10B in the process of being closed to retain therein a pair of signal transmission lines.
Figure 10B:
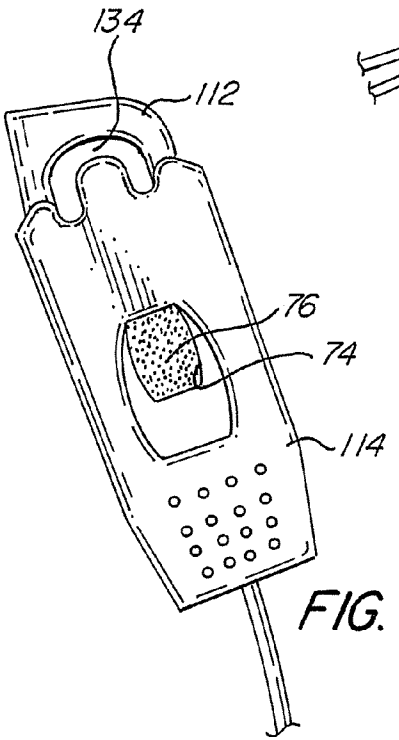
FIG. 10B is the connector clip of FIG. 10A shown in its closed position.

FIGS. 9-9B show an embodiment of the invention which is substantially similar to the embodiment shown in FIGS. 1 and 2-5C. In this case the connector clip 10' comprises a body member 12' which is similar to the body member 12 of the embodiment of FIGS. 1 and 2-5C. In this case, however, closure member 14' has formed in the top thereof a window opening 13 and body member 12' has at the top thereof a display area 15. When connector clip 10' is in the open position as shown in FIG. 9A, display area 15 is not prominently displayed but is recessed within window opening 13. When connector clip 10' is in the closed position as shown in FIG. 9B, display area 15 is closer to window opening 13 and, in some embodiments, may even protrude slightly therefrom. This feature enables the user to judge from a distance whether the connector block is in the closed or open position depending upon the proximity of display area 15 to window opening 13 and hence the visibility, especially from a distance, of display area 15. Advantageously, display area 15 may be of a contrastingly different color (e.g., red or yellow) from closure member 14 (e.g., white or gray). Conveniently, all of body member 12' may be made of a contrastingly different color from all of closure member 14'. This is an advantageous feature when the user is responsible for checking dozens or hundreds of such connector clips in the field to assure that each is in the closed position in order that the signal transmission lines contained therein are securely retained.

Figure 10A:
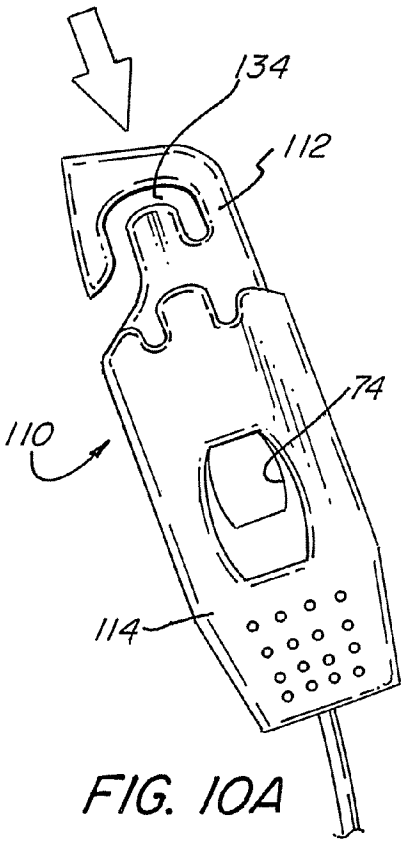
FIG. 10A is a perspective view of a connector clip in accordance with a fourth embodiment of the present invention shown in its open position.

FIGS. 10A-17 show additional exemplary embodiments of the connector clip of the invention. FIG. 10A shows an embodiment of the invention in which connector clip 110 is comprised of a body member 112 mounted exteriorly of a closure member 114 for sliding movement relative thereto between the open position of FIG. 10A, to the closed position of FIG. 10B. A line-retaining slot 134 is defined by closure member 114 and it is seen that in the open position of FIG. 10A a plurality of signal transmission lines 68 (FIG. 10C) may readily be laterally inserted therein and subsequently locked into place by movement to the closed position of FIG. 10B. A visual signal opening 74 is provided in closure member 114 and a visual signal area 76 (FIG. 10B) is provided on body member 112. When connector clip 110 is in the closed position illustrated in FIG. 10B, visual signal opening 74 is aligned with visual signal area 76, which may be in a bright or contrasting color relative to the color of closure member 114, to provide an easily discernible visual signal that connector clip 110 is in the closed position. FIG. 10C illustrates an operator utilizing his thumb to move closure member 114 to the closed position after having inserted signal transmission lines 68 laterally into line-retaining slot 134 while connector clip 110 was in its open position.

Figure 11C:
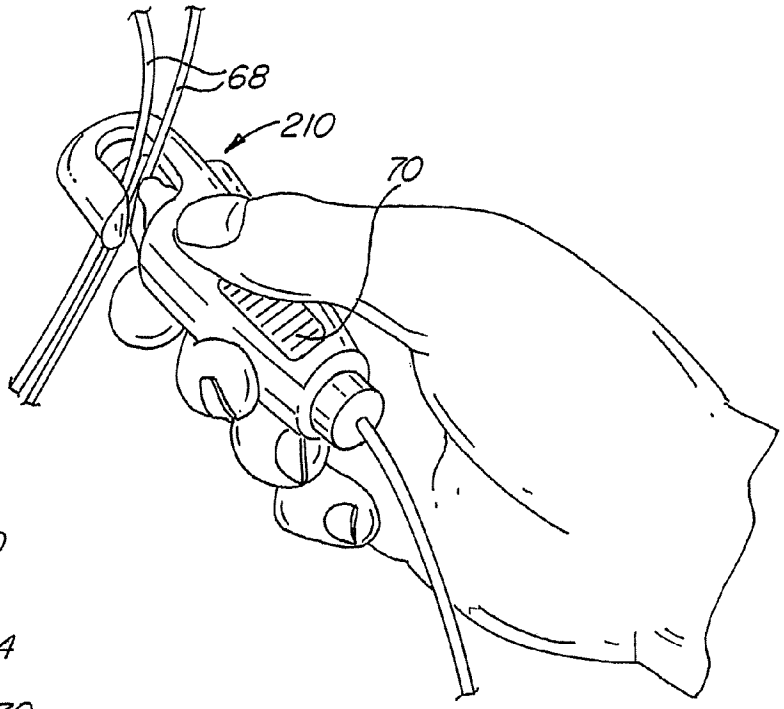
FIGS. 11A, 11B and 11C correspond, respectively, to FIGS. 10A, 10B and 10C but show a fifth embodiment of the present invention.
Figure 11B:
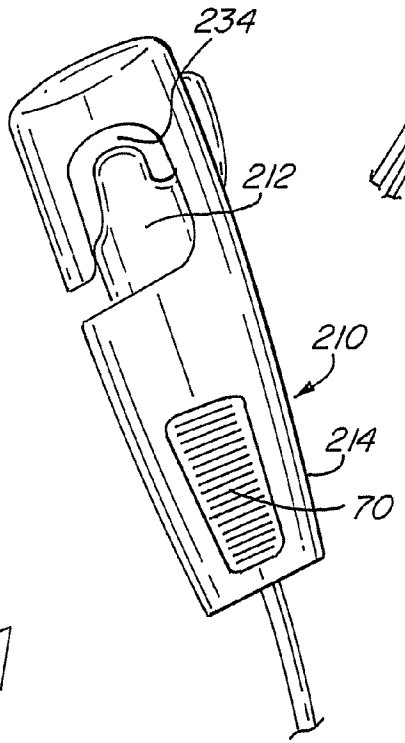
Figure 11A:
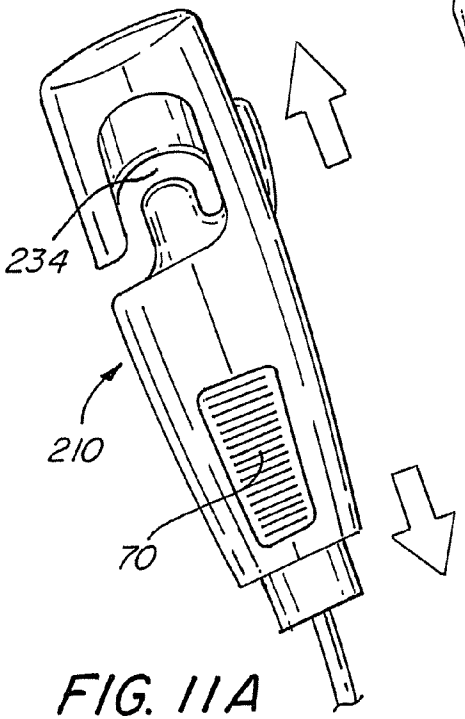

FIGS. 11A and 11B show yet another embodiment of the present invention comprising a connector clip 210 in its open position (FIG. 11A) and in its closed position (FIG. 11B). In this embodiment, closure member 214 is slidably disposed about the exterior of body member 212 and the line-retaining slot 234 is formed on body member 212. FIG. 11C shows a user employing his thumb to move connector clip 210 from the open position shown in FIG. 11C to the closed position shown in FIG. 11B. Such operation is facilitated by a thumb recess 70 formed in closure member 214. As in FIG. 10C, only two signal transmission lines 68 are shown in FIG. 11C. It will, however, be appreciated that as in all the illustrated embodiments of the invention, fewer, i.e., one, or more signal transmission lines 68 may be inserted into line-retaining slot 234. For example, as many as six or eight such signal transmission lines 68 may be laterally inserted into and retained within line-retaining slot 234 and in the line-retaining slots of the other illustrated embodiments of the invention. (The signal transmission lines are omitted from FIGS. 10A, 10B, 11A, 11B, 12A, 12B, 13A and 13B.)

Figure 12C:
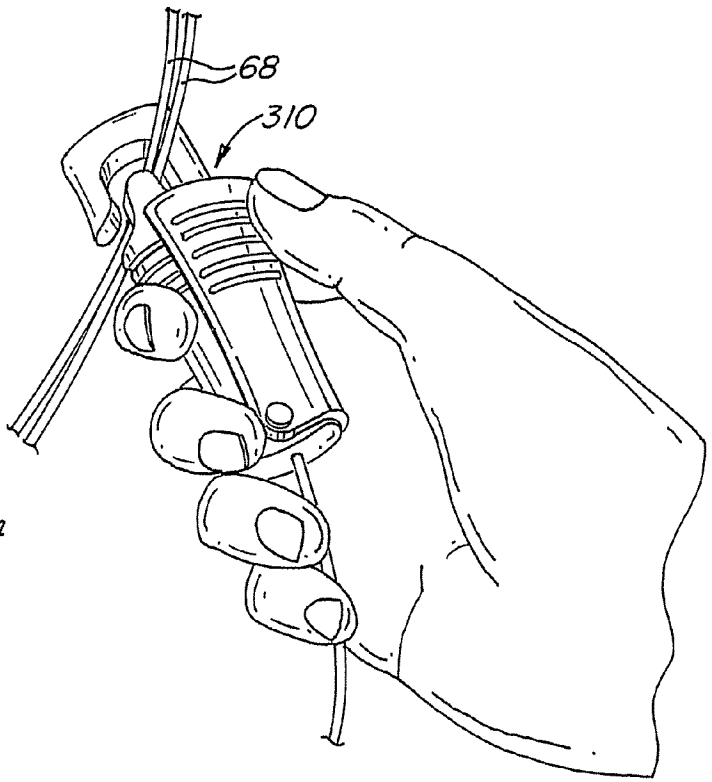
FIGS. 12A, 12B and 12C correspond, respectively, to FIGS. 10A, 10B and 10C but show a sixth embodiment of the present invention.
Figure 12B:
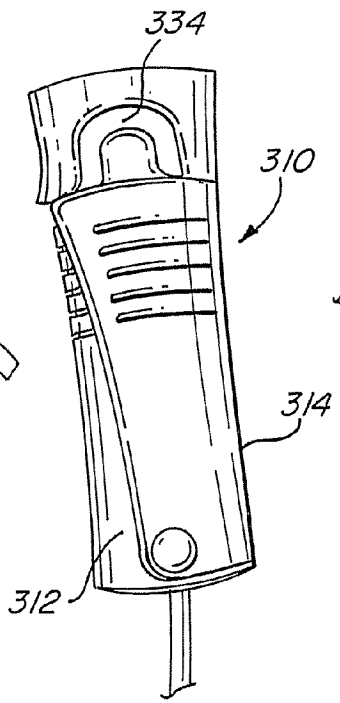
Figure 12A:
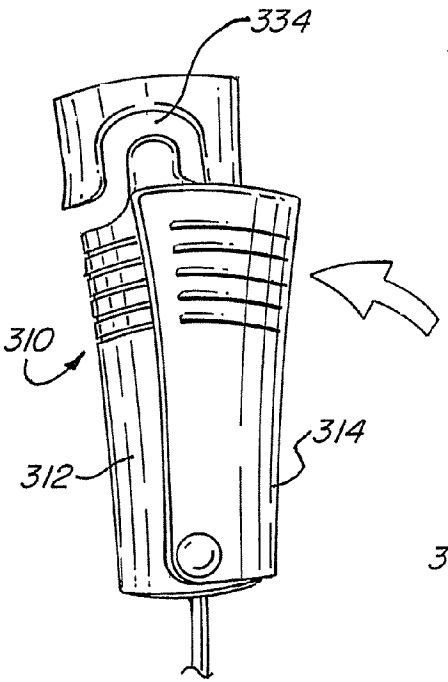

FIGS. 12A and 12B show a connector clip 310 having a closure member 314 pivotably mounted for pivoting movement about the exterior of a body member 312 in which a line-retaining slot 334 is formed. In the open position of FIG. 12A, a plurality of signal transmission lines 68 may readily be laterally inserted into line-retaining slot 334 as shown in FIG. 12C. Once the desired number of signal transmission lines 68 have been so inserted, the operator may use his thumb as illustrated in FIG. 12C to move closure member 314 pivotably to the closed position shown in FIG. 12B.

Figure 13C:
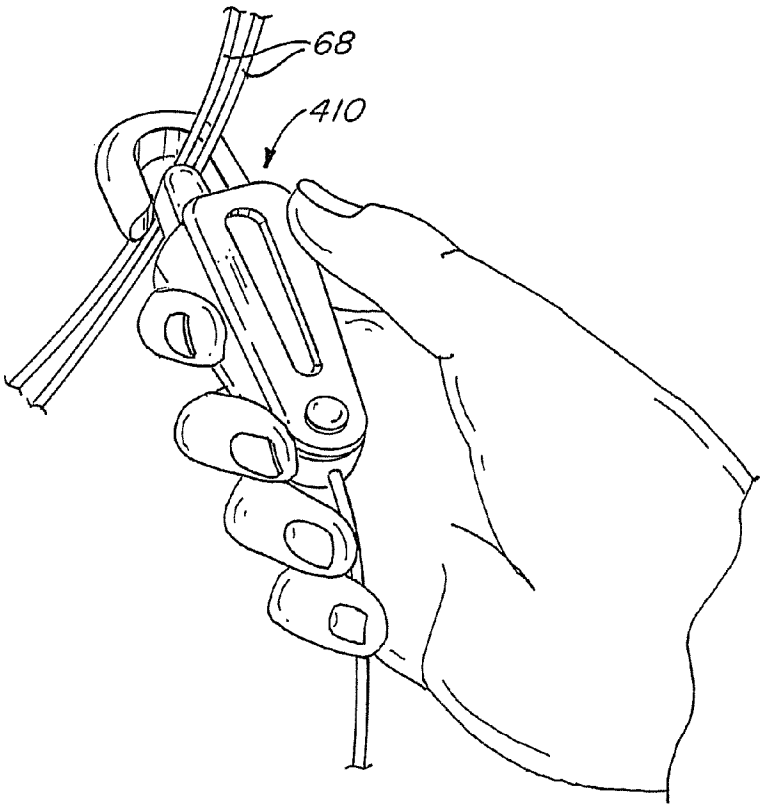
FIGS. 13A, 13B and 13C correspond, respectively, to FIGS. 10A, 10B and 10C but show a seventh embodiment of the present invention.
Figure 13B:
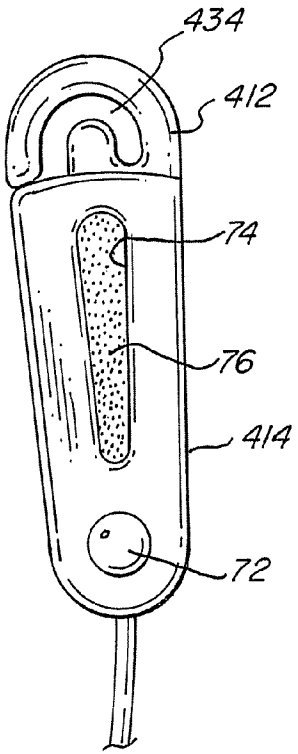
Figure 13A:
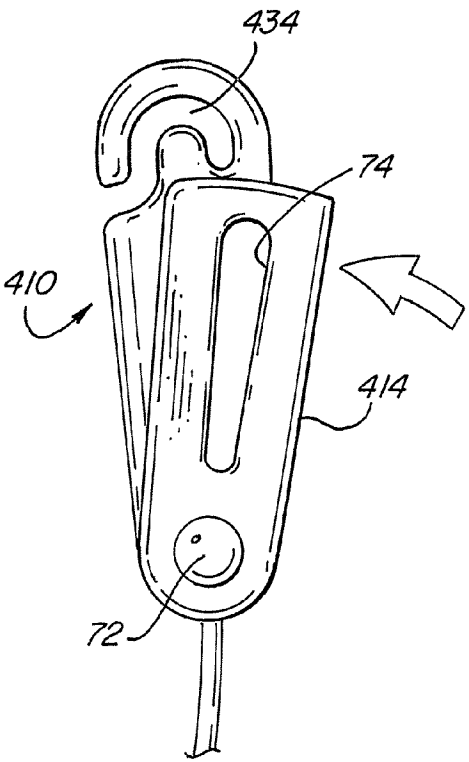

FIGS. 13A and 13B show yet another embodiment of the present invention comprising a body member 412 having a closure member 414 pivotably mounted on a pivot pin 72 for pivoting movement about the exterior of body member 412. A line-retaining slot 434 is formed in body member 412. In the open position shown in FIG. 13A (and in FIG. 13C), a plurality of signal transmission lines 68 may readily be laterally inserted into line-retaining slot 434. Thereafter, as illustrated in FIG. 13C, the operator may use his thumb to push closure member 414 into the closed position illustrated in FIG. 13B. In this embodiment, a visual signal opening 74 is fowled in closure member 414. An identical visual opening slot (not visible in FIGS. 13A-13C) is formed on the opposite side of closure member 414 which is U-shaped in cross section so that when in the closed position it encloses both sides of body member 412. When in the closed position in FIG. 13B, a visual signal area 76 of body member 412 is visible through visual signal opening 74 thereby providing a visual signal that closure member 14 is locked into its closed position. Visual signal area 76 may be made in a bright or contrasting color relative to closure member 414, to provide a readily discernible indication that connector clip 410 is in its closed position.

In the several embodiments of FIGS. 10A-13C, each may be provided with a locking element, such as elements 62 (FIG. 5A), of the closure member and an engagement contouring 42 (FIG. 6A) of the body member. These elements may be configured to provide both the tactile resistance indicating entry into and leaving of the open and closed positions, and/or an audible click upon entering into or leaving the open and closed positions.

Figure 14:
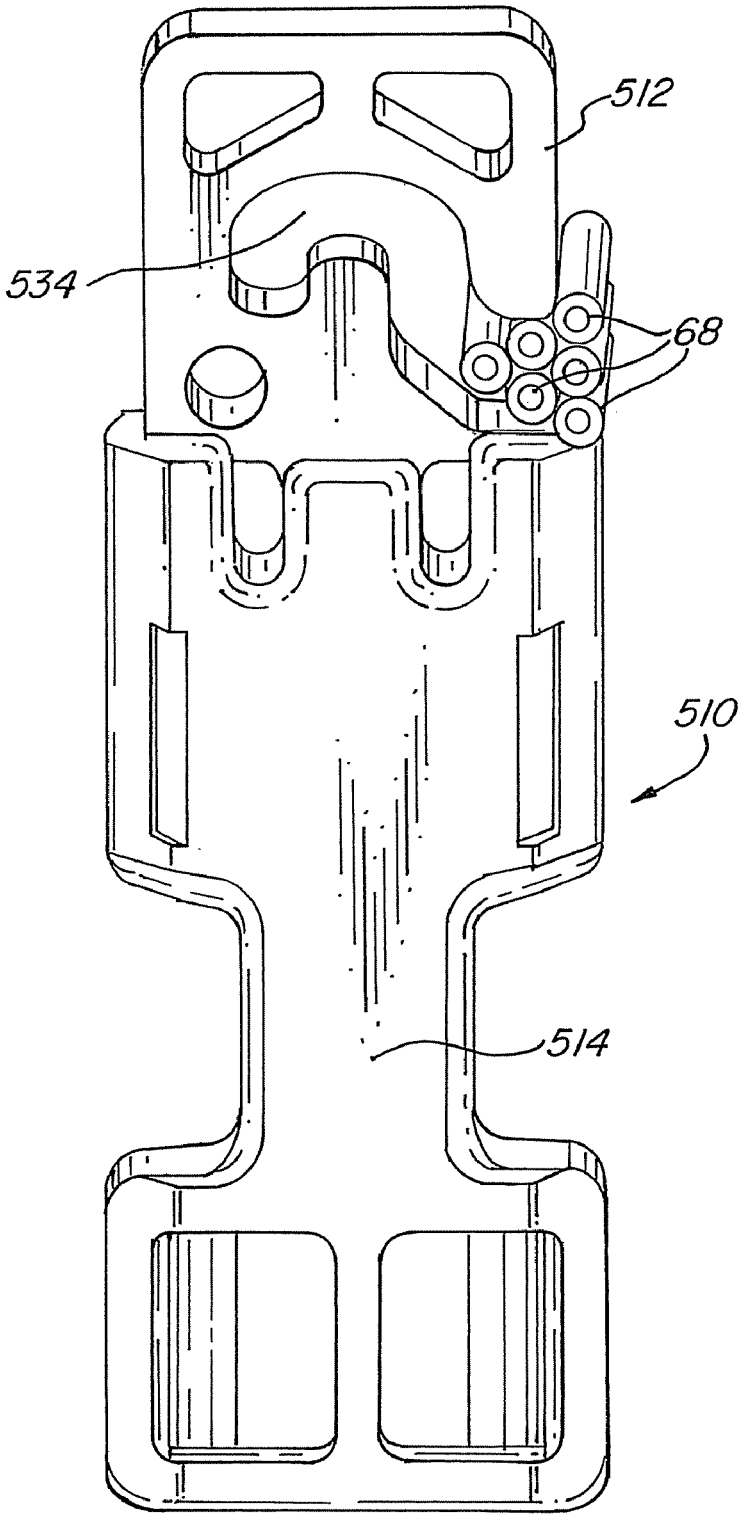
FIG. 14 shows an eighth embodiment of the present invention in its open position with a plurality of (broken-away) transmission lines positioned at the access opening comprising the entrance to the line-retaining slot.
Figure 15:
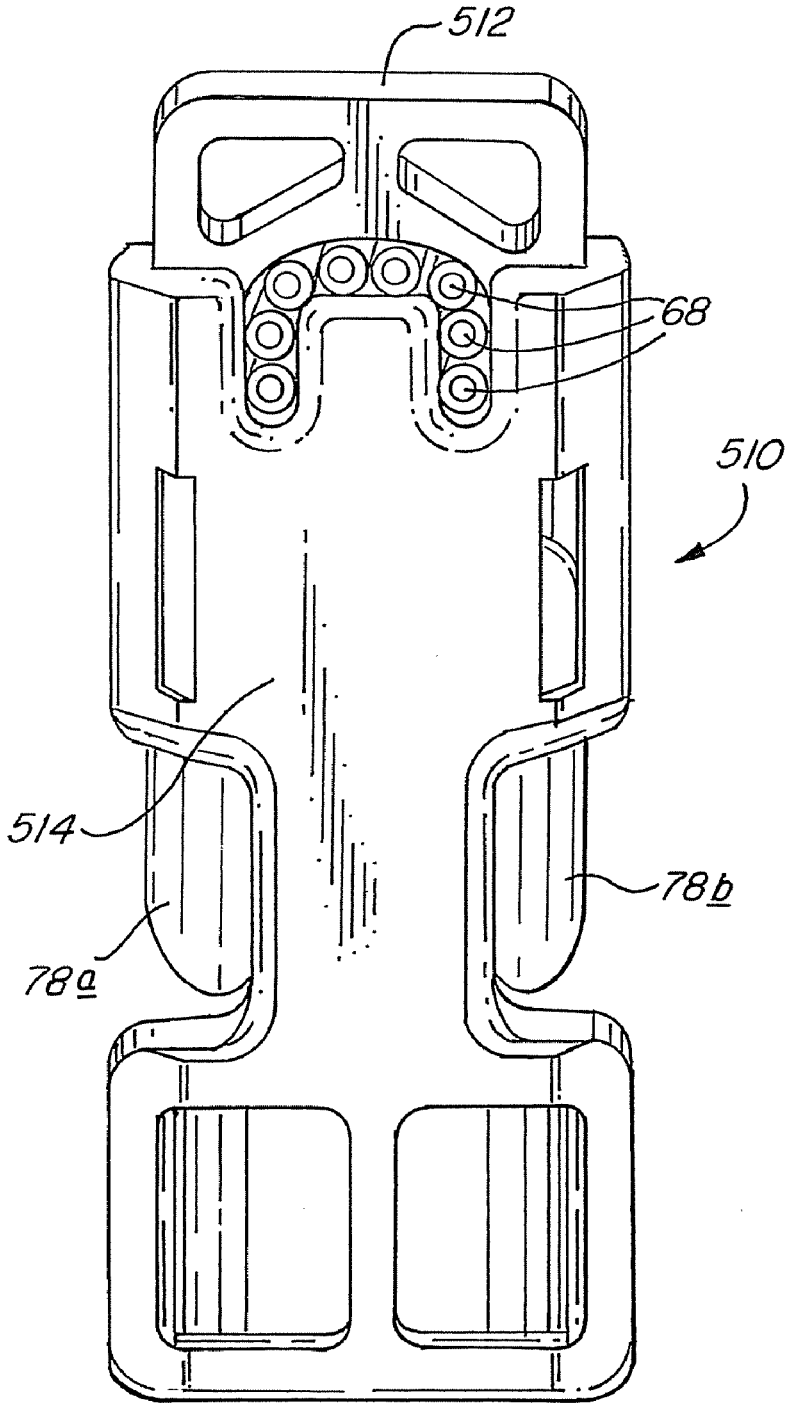
FIG. 15 is a perspective view of the connector clip of FIG. 14 in its closed position with the (broken-away) transmission lines retained within the line-retaining slot.

FIG. 14 illustrates yet another embodiment of the present invention in which a connector clip 510 is comprised of a body portion 512 which is slidably received within a closure portion 514. In this embodiment, the detonator (not shown in FIG. 14) is received within the closure portion 514 and the line-retaining slot 534 is formed within body member 512. A plurality of signal transmission lines 68 is shown in a stacked position at the entryway to line-retaining slot 534. After insertion of the signal transmission lines 68 in a single layer within line-retaining slot 534, closure member 514 and body member 512 are moved towards each other to lock the signal transmission lines 68 into place as illustrated in the closed position of FIG. 15. In this embodiment, as best seen in FIG. 15, a pair of resilient locking legs 78*a*, 78*b* are pressed together upon movement to the closed position of FIG. 15 and detents formed thereon lock the body member 512 and the closure 514 together. As in the other embodiments, connector clip 510 may be moved from the closed position of FIG. 15 back to the open position of FIG. 14 in case it is desired to remove or add additional signal transmission lines 68. This is readily accomplished by squeezing resilient legs 78*a*, 78*b* in the direction shown by the arrows in FIG. 15 to release the legs from the detent formed in closure 514 and then slide body member 512 and closure member 514 apart to restore the open position illustrated in FIG. 14.

Figure 16:
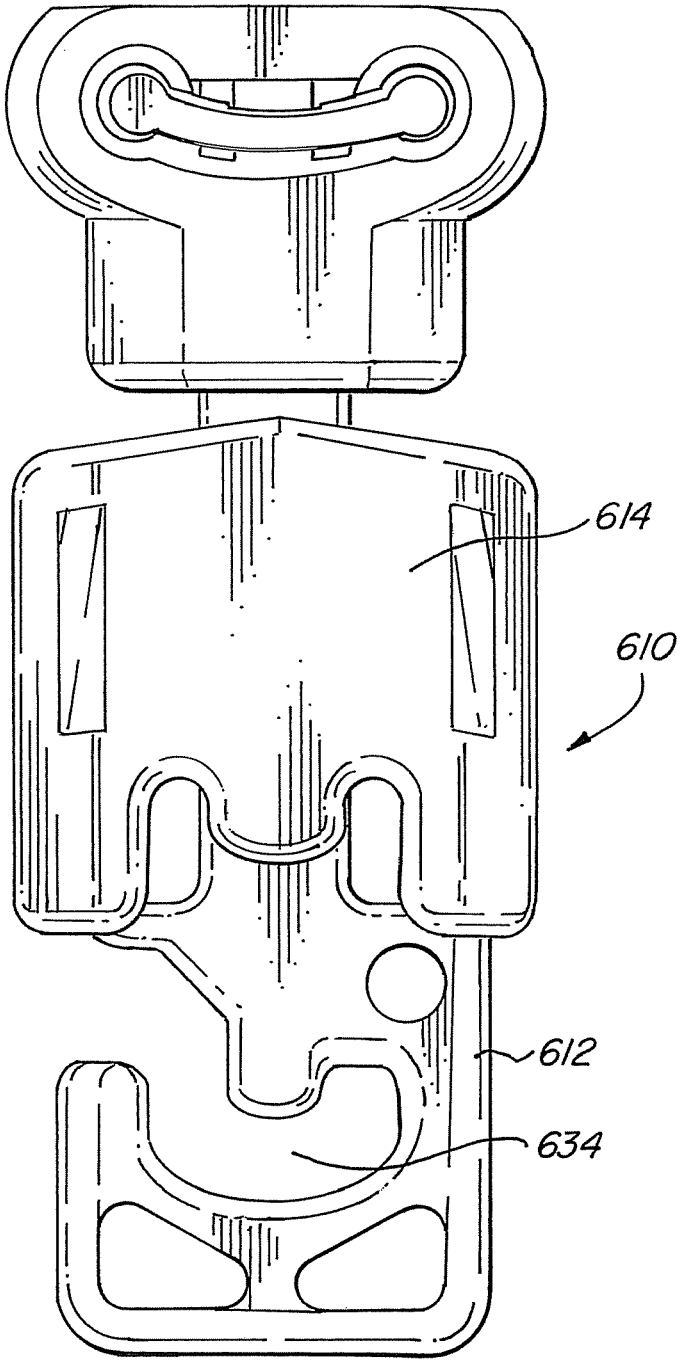
FIG. 16 is a view of a ninth embodiment of the present invention shown in its open position.
Figure 17:
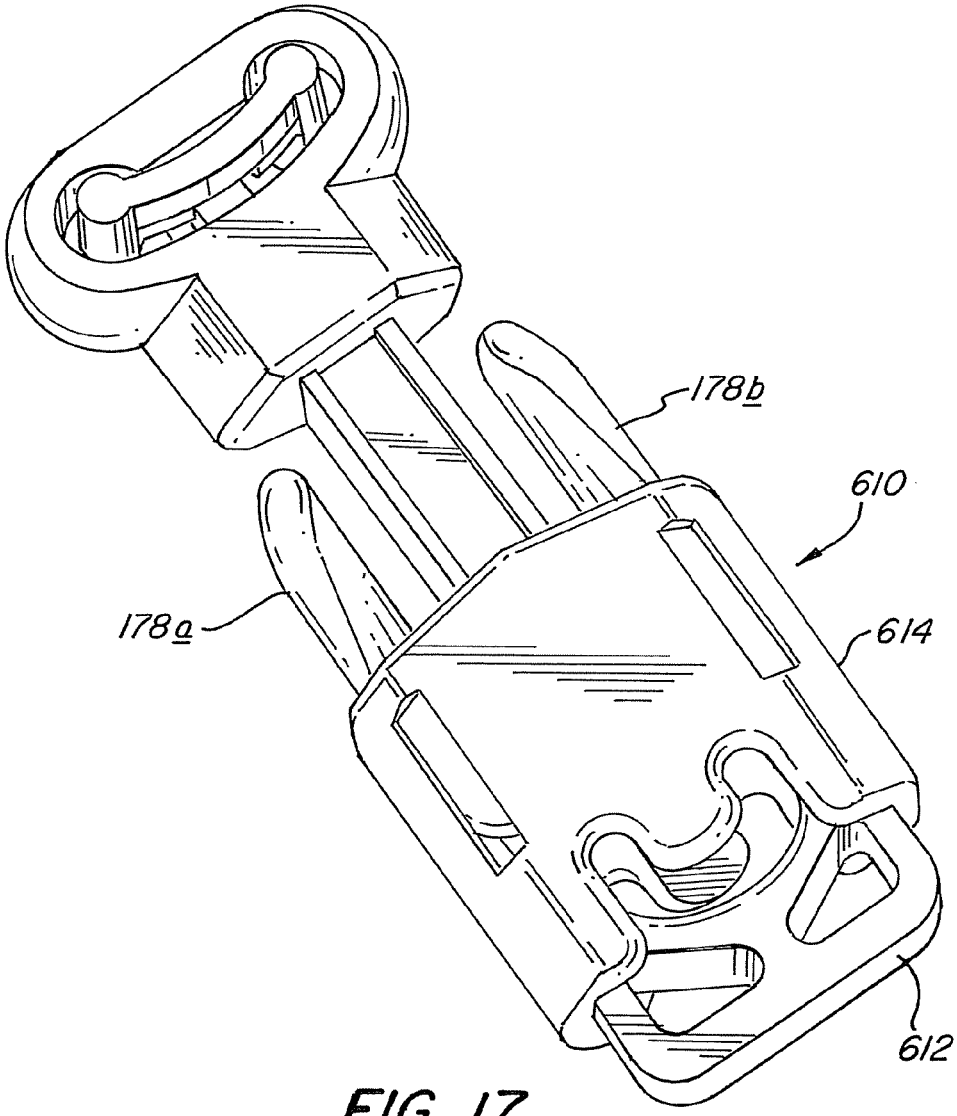
FIG. 17 is a view of the connector clip of FIG. 16 in its closed position.

FIGS. 16 and 17 show yet another embodiment comprising connector clip 610 comprised of a body portion 612 within which is formed a line-retaining slot 634 and a closure portion 614 which is slidably mounted on the exterior of body portion 612. In the open position of FIG. 16, a plurality of signal transmission lines (not shown in FIGS. 16 and 17) may readily be laterally inserted into line-retaining slot 634 after which body member 612 and closure member 614 are moved towards each other into the closed position of FIG. 17. As with the embodiment of FIGS. 14 and 15, a pair of resilient locking legs 178*a*, 178*b* are compressed into engagement with a detent (not shown) on the interior of closure member 614. Squeezing resilient legs 178*a*, 178*b* together in the direction of the arrows shown in FIG. 17 will disengage body member 612 from closure member 614 to restore the open position, in the manner as described above with respect to FIGS. 14 and 15.

Generally, the connector clips of the present invention may be made from any suitable material. For example, body member 12 may be made of high density polyethylene as may be closure member 14. Because of the thin cross section of closure member 14 in the embodiment of FIGS. 1 and 2-5C, a stiffer material may be employed in its manufacture such as acrylonitrile-butadiene-styrene ("ABS"), polypropylene or high-density polyethylene. Optionally, a filler such as glass fiber may be used in any of those materials to further enhance stiffness.

While the invention has been described in detail with respect to a specific embodiment thereof, it will be appreciated that the invention has other applications and may be embodied in numerous variations of the illustrated embodiment.

What is claimed is:

1. In a connector clip for retaining one or more signal transmission lines in proximity to a detonator having an explosive end, the clip having a longitudinal axis and comprising:

a body member configured to receive and retain such detonator therein, a closure member and a line retainer, the line retainer and the body member cooperating to define a line-retaining slot having an access opening configured: (i) to laterally receive therein one or more signal transmission lines in signal-transfer proximity to the explosive end of such detonator, and (ii) to retain at least those portions of such lines as are confined within the slot disposed substantially perpendicularly to the longitudinal axis of the clip;

the improvement comprising that: (a) the closure member and the body member are mounted one on the other for movement relative to each other along a travel path between (1) an open position in which the line-retaining slot is accessible to lateral insertion therein of one or more signal transmission lines, and (2) a closed position in which the line-retaining slot is closed to secure such signal transmission lines therein, and (b) the travel path is parallel to the longitudinal axis of the connector clip, and one of the body member and the closure member defines a cavity within which at least part of the other is encased during said movement between the open position and the closed position.

2. The connector clip of claim 1 wherein the closure member defines the cavity, and at least part of the body member is encased within the cavity during movement along the travel path between the open position and the closed position.

3. In a connector clip for retaining one or more signal transmission lines in proximity to a detonator having an explosive end, the clip having a longitudinal axis and comprising:

a body member configured to receive and retain such detonator therein, a closure member and a line retainer, the line retainer and the body member cooperating to define a line-retaining slot having an access opening configured to laterally receive therein one or more signal transmission lines in signal-transfer proximity to the explosive end of such detonator;

the improvement comprising that: (a) the closure member and the body member are mounted one on the other for movement relative to each other along a travel path between (1) an open position in which the line-retaining slot is accessible to lateral insertion therein of one or more signal transmission lines, and (2) a closed position in which the line-retaining slot is closed to secure such signal transmission lines therein, (b) the travel path is parallel to the longitudinal axis of the connector clip, and (c) the body member defines a cavity within which at least part of the closure member is encased during movement along the travel path between the open position and the closed position.

4. The connector clip of claim 1, claim 3 or claim 2 wherein such signal transmission lines have outside diameters and the line-retaining slot, including its access opening, has a width which is not less than that of the outside diameters of such signal transmission lines, thereby enabling lateral insertion of the signal transmission lines through the access opening into the line-retaining slot without compression of the lines.

5. In a connector clip for retaining one or more signal transmission lines in proximity to a detonator having an explosive end, the clip having a longitudinal axis and comprising:

a body member configured to receive and retain such detonator therein, a closure member and a line retainer, the line retainer and the body member cooperating to define a line-retaining slot having an access opening configured to laterally receive therein one or more signal transmission lines in signal-transfer proximity to the explosive end of such detonator;

the improvement comprising that: (a) the closure member and the body member are slidable relative to each other and mounted one on the other for sliding movement relative to each other along a travel path between (1) an open position in which the line-retaining slot is accessible to lateral insertion therein of one or more signal transmission lines, and (2) a closed position in which the line-retaining slot is closed to secure such signal transmission lines therein, and (b) the travel path is parallel to the longitudinal axis of the connector clip, and one of the body member and the closure member defines a cavity within which at least part of the other is encased during said movement between the open position and the closed position, and wherein the access opening has a width A and the amount of relative movement between the closure member and the body member in moving between the open position and the closed position is from about A to about 2A.

6. The connector clip of claim 5 wherein the relative movement is about equal to the width A.

7. In a connector clip for retaining one or more signal transmission lines in proximity to a detonator having an explosive end, the clip comprising:

a body member configured to receive and retain such detonator therein, a closure member and a line retainer, the line retainer and the body member cooperating to define a line-retaining slot having an access opening configured to laterally receive therein one or more signal transmission lines in signal-transfer proximity to the explosive end of such detonator;

the improvement comprising that: (a) the closure member and the body member are mounted one on the other for movement relative to each other along a travel path between (1) an open position in which the line-retaining slot is accessible to lateral insertion therein of one or more signal transmission lines, and (2) a closed position in which the line-retaining slot is closed to secure such signal transmission lines therein; and (b) the body member has thereon a visible indicator which is at least partly obscured by the closure member when the members are in the open position and which is revealed or more fully revealed by the closure member when the members are in the closed position.

8. The connector clip of claim 7 wherein the body member and the closure member have thereon, respectively, a body member engagement formation and a closure member engagement formation, the formations being configured to engage each other when the members are in the closed position.

9. The connector clip of claim 8 wherein the formations are configured to create resistance to movement of the members from the closed position towards the open position, which resistance is slight enough to be manually overcome by a user of the connector clip.

10. In a connector clip having a longitudinal axis and being otherwise configured (a) to retain therein a detonator having an explosive end, and (b) to receive and retain therein one or more signal transmission lines each having a respective outside diameter, the clip comprising:

a body member configured to receive therein at least the explosive end of such detonator;

a line retainer carried on the body member and defining a signal transmission line-retaining slot having an access opening, the slot and its access opening being configured to laterally receive therein one or more of such signal transmission lines disposed in signal-transfer proximity to the explosive end of such detonator, and with at least those portions of the lines which are confined within the slot being disposed substantially perpendicularly to the longitudinal axis;

the improvement comprising that: a closure member is movably connected to the body member for movement relative to the body member along a travel path which is parallel to the longitudinal axis of the clip between (1) an open position in which the line-retaining slot is accessible via the access opening to lateral insertion therein of one or more of such signal transmission lines, and (2) a closed position in which the access opening of the line-retaining slot is closed by the closure member to secure such signal transmission lines within the slot; and the slot, including its access opening, has a width which is not less than that of the outside diameters of such signal transmission lines, thereby enabling lateral insertion of such lines through the access opening into the slot without compression of the lines.

11. The connector clip of any one of claim 1, 3, 2 or 10 wherein the body member and the closure member are slidable relative to each other for sliding movement along the travel path.

12. The connector clip of claim 10 wherein the closure member defines a cavity within which at least part of the body member is encased during said movement between the open position and the closed position.

13. The connector clip of claim 10 wherein the body member defines a cavity within which at least part of the closure member is encased during said movement between the open position and the closed position.

14. The connector clip of any one of claim 1, 3, 2, 10, 12 or 13 wherein the body member comprises a longitudinally-extending first bore and the closure member comprises a longitudinally-extending second bore, the first and second bores being aligned with each other and configured to each receive a longitudinal portion of such detonator at least when the body member and the closure member are in the closed position.

15. The connector clip of claim 1 or claim 10 wherein the body member and the closure member have thereon, respectively, a body member engagement formation and a closure member engagement formation, the formations being configured to engage each other when the members are in the closed position.

16. The connector clip of claim 15 wherein the formations are configured to create resistance to movement of the members from the closed position towards the open position, which resistance is slight enough to be manually overcome by a user of the connector clip.

17. The connector clip of any one of claim 1, 3, 2 or 10 wherein one of the body member and the closure member has thereon a visible indicator which is at least party obscured when the members are in the open position and which is revealed or more fully revealed when the members are in the closed position.

18. The connector clip of any one of claim 1, 3, 2 or 10 wherein the access opening has a width A and the amount of relative movement between the closure member and the body member in moving between the open position and the closed position is from about A to about 2A.

19. In a connector clip for retaining one or more signal transmission lines in proximity to a detonator having an explosive end, the clip having a longitudinal axis and comprising:

a body member having a body member longitudinal axis and being configured to receive and retain such detonator therein, a closure member having a closure member longitudinal axis and further having a line retainer thereon, the line retainer and the body member cooperating to define a line-retaining slot having an access opening configured to laterally receive therein one or more signal transmission lines in signal-transfer proximity to the explosive end of such detonator;

the improvement comprising that: (a) the closure member and the body member are mounted one on the other for pivotable movement relative to each other in a travel path lying in a plane parallel to the both the body member and the closure member longitudinal axes between (1) an open position in which the line-retaining slot is accessible to lateral insertion therein of one or more signal transmission lines, and (2) a closed position in which the line-retaining slot is closed to secure such signal transmission lines therein, and (b) one of the body member and the closure member defines a cavity within which at least part of the other is en-cased during said movement between the open position and the closed position.

20. The connector clip of claim 19 wherein the access opening has a width A and the amount of relative movement between the closure member and the body member at the access opening in moving between the open position and the closed position is from about A to about 2A.

21. The connector clip of claim 20 wherein the amount of relative movement at the access opening is about A.

22. The connector clip of claim 19 wherein the body member defines the cavity, and at least part of the closure member is encased within the cavity during movement along the travel path between the open position and the closed position.

23. The connector clip of claim 19 wherein the closure member defines the cavity, and at least part of the body member is encased within the cavity during movement along the travel path between the open position and the closed position.

24. The connector clip of claim 19 wherein the slot, including its access opening, has a width which is not less than that of the outside diameters of such signal transmission lines, thereby enabling lateral insertion of such lines through the access opening into the slot without compression of the lines.

* * * * *